US007172011B2

(12) United States Patent
Bing et al.

(10) Patent No.: US 7,172,011 B2
(45) Date of Patent: Feb. 6, 2007

(54) METHOD FOR THE PRODUCTION OF A LOST-FOAM CASTING MODEL FOR A LIGHT METAL CYLINDER LINER

(75) Inventors: Karlheinz Bing, Remseck (DE); Frank Winger, Stuttgart (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 11/491,041

(22) Filed: Jul. 21, 2006

(65) Prior Publication Data

US 2006/0254743 A1 Nov. 16, 2006

Related U.S. Application Data

(63) Continuation-in-part of application No. 10/478,789, filed as application No. PCT/DE02/01860 on May 21, 2002, now abandoned.

(30) Foreign Application Priority Data

May 25, 2001 (DE) ..... 101 25 615

(51) Int. Cl.
*B22C 7/02* (2006.01)

(52) U.S. Cl. ..... 164/34; 164/45

(58) Field of Classification Search ..... 164/34, 164/35, 45

See application file for complete search history.

(56) References Cited

U.S. PATENT DOCUMENTS

| | | | | |
|---|---|---|---|---|
| 4,657,063 | A | 4/1987 | Morris | 164/45 |
| 4,986,942 | A | 1/1991 | Irgens et al. | 264/51 |
| 5,027,878 | A | 7/1991 | Revankar et al. | 164/98 |
| 6,732,632 | B1 | 5/2004 | Grahle et al. | 92/171.1 |
| 2004/0173334 | A1* | 9/2004 | Bing et al. | 164/35 |

FOREIGN PATENT DOCUMENTS

| | | |
|---|---|---|
| DE | 3619170 | 12/1987 |
| DE | 39 09 521 | 10/1989 |
| DE | 3824574 | 1/1990 |
| DE | 3613003 | 2/1996 |
| DE | 199 58 185 | 6/2001 |
| EP | 0421374 | 4/1991 |
| EP | 0 532 331 | 3/1993 |
| EP | 0834361 | 4/1998 |

* cited by examiner

*Primary Examiner*—Kevin P. Kerns
(74) *Attorney, Agent, or Firm*—Collard & Roe, P.C.

(57) ABSTRACT

A light metal cylinder liner with a surface which facilitates the connection with the surrounding cast material may be produced. The cylinder liner is produced by a lost-foam method with a form for production of the cast foam model having a structured surface with height variations of 0.8 to 5 mm. The structured surface is, for example, grooves or longitudinal elevations.

7 Claims, 1 Drawing Sheet

METHOD FOR THE PRODUCTION OF A LOST-FOAM CASTING MODEL FOR A LIGHT METAL CYLINDER LINER

CROSS-REFERENCE TO RELATED APPLICATIONS

This is a continuation-in-part of U.S. patent application Ser. No. 10/478,789, filed on Apr. 26, 2004 now abandoned, which claims priority under 35 USC 365 of PCT/DE02/01860 filed on May 21, 2002. The international application under article 21(2) was not published in English. The international application claims priority under 35 USC 119 of German Application No. 101 25 615.9 filed on May 25, 2001. Thus, priority of both the International and German applications is also claimed for the present application.

BACKGROUND OF THE INVENTION

1. Field of the Invention

The invention relates to a method for the production of a lost-foam casting model for a light metal cylinder liner of internal combustion engines.

2. The Prior Art

It is known to cast light metal cylinder liners having an elevated silicon content in engine blocks, using the composite casting method. In this connection, it is necessary to produce a good connection, either as a positive lock or in terms of material, between the base material having a lower Si content and the cylinder liner having a higher Si content. A prerequisite for such locking together of the cylinder liner and the base material is, among other things, a rough, fissured surface of the cylinder sleeve that is to be cast into place.

In order to produce this rough and fissured surface, different methods have already been proposed: blasting, milling of depressions, or reshaping of the surface of the cylinder liner by means of pressure rollers. It is known from European Patent Application No. 0 532 331 to work notches into the surface of a cylinder lining when producing it, using a rolling method or a casting method. All of the methods require another processing step subsequent to the production of the cylinder liner by means of casting technology.

It is furthermore known from German Patent No. DE 3909521 to produce cylinder liners using the lost-foam method. In this connection, the lost-foam casting model is produced in a multi-part mold, whereby the outside surface of the model remains unstructured.

It is known from German Patent No. DE 19958185, which is not a prior publication, to produce a lost mold, more precisely a lost-foam casting model, having a structured outside surface, in that particles are applied adhesively to the smooth surface of a lost mold, which particles produce undercuttings when the light metal cylinder liner is cast.

SUMMARY OF THE INVENTION

It is an object of the invention to produce a light metal cylinder liner having a structured surface, in simple manner. This problem is solved in that the mold for the production of the lost-foam casting model of a cylinder liner has a structured surface with height variations of 0.8 to 5 mm, at least in partial regions.

In the production of the lost-foam casting model in the mold according to the invention, a structured outside surface is formed on the model. Later, the model is embedded in casting sand and brought into connection with melt by way of a casting channel. When this is done, the model is replaced by the melt. The surface structure of the model is reproduced on the casting, forming a cylinder liner having a structured surface, without any additional machining being required.

In a standard case, the lost-foam casting model consists of polystyrene.

The height variations on the surface of the cylinder liner that form the structured surface amount to 0.8 to 5 mm, preferably 1 to 3 mm, and particularly preferably 1 to 2 mm.

In this connection, the height variations can be formed either by grooves or by elevations, and the grooves or elevations can run preferably in the axial direction, in the circumference direction, or in a diagonal direction. Furthermore, grooves and elevations can also extend in wave shape. Combinations of the stated progressions are also possible.

The grooves can be made in the mold for the production of the lost-foam casting model by means of milling, for example; the elevations can be applied by means of application welding. The erosion method is also a possibility.

The mold for the production of the lost-foam casting model must be parted in such a manner that the lost-foam casting model can be reliably unmolded. It can particularly be divided into two mold halves or four mold parts.

The method according to the invention comprises the following steps:

(1) providing a metal casting mold for the production of a model of a cylinder sleeve made of foam material, the casting mold having a cylindrical opening and having a cylinder-shaped core disposed within the opening and oriented coaxial to the opening, wherein a difference of radii of the opening and of the core corresponds to a wall thickness of the model, (2) working grooves and elevations into a surface of the opening, the grooves and elevations having a height difference of 0.8 mm to 5 mm;

(3) filling foam material into the casting mold; and (4) molding the model.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

DETAILED DESCRIPTION OF THE PREFERRED EMBODIMENT

Figure 1:
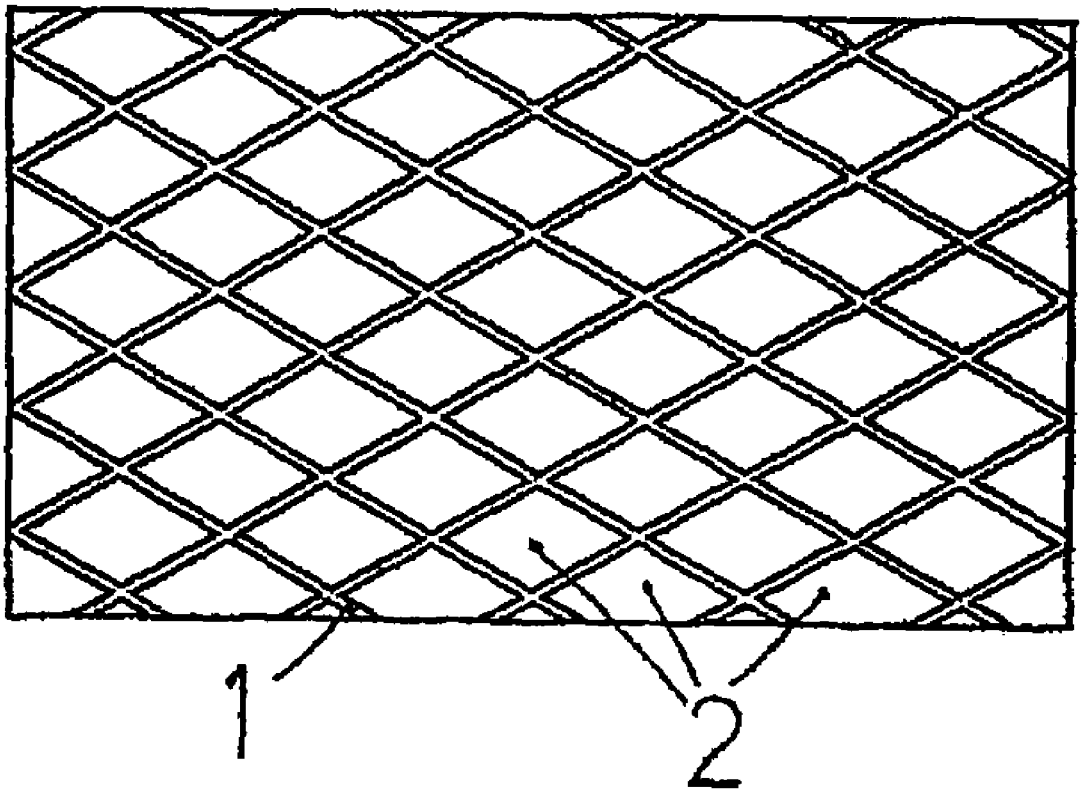
FIG. 1 shows a surface of a mold for the production of a lost-foam casting model.

Referring now in detail to the drawings, FIG. 1 shows a surface, according to the invention, of a mold for the production of a lost-foam casting model. The surface shows diagonally running grooves 1. Likewise, however, elevations can also be formed instead of the grooves. The surface is divided into diamond-shaped individual areas 2 by the grooves 1. As an alternative to intersecting diamonds, the grooves and elevations can run in a wave shape or in a circumferential direction (not shown).

Accordingly, while only a few embodiments of the present invention have been shown and described, it is obvious that many changes and modifications may be made thereunto without departing from the spirit and scope of the invention.

What is claimed is:

1. A Method for the production of a foam material casting model for a light metal cylinder liner of an internal combustion engine, comprising the following steps:

providing a metal casting mold for the production of a model of a cylinder sleeve made of foam material, said casting mold having a cylindrical opening and having a cylinder-shaped core disposed within the opening and oriented coaxial to the opening, wherein a difference of radii of the opening and of the core corresponds to a wall thickness of the model, working grooves and elevations into a surface of the opening, said grooves and elevations having a height difference of 0.8 mm to 5 mm;

filling foam material into the casting mold; and molding the model.

2. A method according to claim 1, wherein said grooves run in a diagonal direction and intersect each other.

3. A method according to claim 1, wherein said grooves and elevations run in a wave shape.

4. A method according to claim 1, wherein said grooves and elevations run in a circumferential direction.

5. A method according to claim 1, wherein said step of working grooves and elevations in is accomplished by milling.

6. A method according to claim 1, wherein said step of working grooves and elevations in is accomplished by application welding.

7. A method according to claim 1, wherein said step of working grooves and elevations in is accomplished by erosion.

* * * * *